US006560831B2

(12) United States Patent
Schoen

(10) Patent No.: US 6,560,831 B2
(45) Date of Patent: May 13, 2003

(54) LACE LASSO SHOELACE TIE RESTRAINING DEVICE

(76) Inventor: Neil C. Schoen, 9817 Freestate Pl., G'burg, MD (US) 20886

( * ) Notice: Subject to any disclaimer, the term of this patent is extended or adjusted under 35 U.S.C. 154(b) by 0 days.

(21) Appl. No.: 09/950,448

(22) Filed: Sep. 10, 2001

(65) Prior Publication Data

US 2002/0092142 A1 Jul. 18, 2002

Related U.S. Application Data

(60) Provisional application No. 60/261,785, filed on Jan. 17, 2001.

(51) Int. Cl.[7] ..... A43C 7/00; A43C 7/06

(52) U.S. Cl. ..... 24/712.3; 24/712.1; 24/712.2

(58) Field of Search ..... 24/115 F, 115 G, 24/115 H, 115 K, 115 R, 712, 712.1, 712.2, 712.3, 712.4, 712.5, 712.7, 712.8, 712.9; 36/1, 50.1, 50.5

(56) References Cited

U.S. PATENT DOCUMENTS

| | | | | | |
|---|---|---|---|---|---|
| 724,502 | A | * | 4/1903 | Rhinow | 24/712.2 |
| 741,238 | A | * | 10/1903 | Force | 24/712.7 |
| 1,876,505 | A | * | 9/1932 | Berger | 24/712.6 |
| 1,913,102 | A | * | 6/1933 | Berger | 24/712.7 |
| 4,393,550 | A | * | 7/1983 | Yang et al. | 24/712.5 |
| 4,428,101 | A | * | 1/1984 | Harkavy | 24/712.4 |
| 4,485,529 | A | * | 12/1984 | Blum | 24/712.2 |
| 4,780,936 | A | * | 11/1988 | Brecher | 24/712.2 |
| 4,999,888 | A | * | 3/1991 | Miller | 24/712.3 |
| 5,065,482 | A | * | 11/1991 | Lofy | 24/712.1 |
| 5,170,573 | A | * | 12/1992 | Clinch | 36/50.1 |
| 5,657,557 | A | * | 8/1997 | Hull et al. | 36/58.5 |
| 5,896,623 | A | * | 4/1999 | Martin | 24/16 PB |
| 5,924,177 | A | * | 7/1999 | Jongejan | 24/712.2 |
| 6,000,111 | A | * | 12/1999 | Deskins et al. | 24/12.3 |
| 6,026,548 | A | * | 2/2000 | Jackson | 24/712 |
| 6,126,237 | A | * | 10/2000 | Ritterhouse | 24/115 G X |
| 6,178,606 | B1 | * | 1/2001 | Glendon | 24/712.5 |
| 6,260,246 | B1 | * | 7/2001 | Lampkins | 24/712.1 |
| 6,295,704 | B1 | * | 10/2001 | Rivas | 24/712.1 |
| 6,321,466 | B1 | * | 11/2001 | Bordin et al. | 36/54 |
| 6,334,240 | B1 | * | 1/2002 | Li | 24/115 G |

FOREIGN PATENT DOCUMENTS

| | | | | |
|---|---|---|---|---|
| DE | 513 335 | * | 11/1930 | 24/712.1 |
| GB | 13408 | * | 6/1899 | 24/712.3 |
| GB | 4256 | * | 2/1903 | 24/712.3 |
| GB | 310883 | * | 1/1929 | 24/712.1 |
| GB | 347521 | * | 4/1931 | 24/712.1 |

OTHER PUBLICATIONS

Lampkins, May 2002, U.S. patent application Publication US 2002/0059738 A1.*

* cited by examiner

*Primary Examiner*—J. J. Swann
*Assistant Examiner*—Ruth C. Rodriguez

(57) ABSTRACT

A device to prevent the unraveling of common bow-tie shoelace knots. The four ends of a standard bow-tie knot (two loops and two loose ends) are gathered together in a stalk-like shape, and encircled snugly with an adjustable restraining material, which can then be anchored to the shoe to prevent the knot stalk from flopping around or getting snagged on environmental materials (e.g., branches, twigs, weeds, etc.). Referred to herein as a "lace lasso," the device is light-weight, simple, and rapidly installed and attached to simple and common shoelace knots. The restraining material can be chord, elastic material, or fabric; adjustment in snugness and tension can be accomplished by small spring-loaded ripstop cylinders commonly used in camping gear, or Velcro fabric strips. The device can be attached to the shoe by caribiner-type clips or Velcro fabric strips which are connected to the restraining material wrapped around the ends of the shoelace knot. Extra lace lasso units can be used as holding devices for keys and other small items that a runner may want to carry with him/her, but cannot because running gear may not have pockets.

4 Claims, 4 Drawing Sheets

LACE LASSO SHOELACE TIE RESTRAINING DEVICE

This application claims the benefit of U.S. Provisional Application No. 60/261,785 filed on Jan. 17, 2001.

BACKGROUND OF THE INVENTION

A common problem, especially for those who wear running shoes, is the inadvertent unraveling of the shoelace bow tie knot. In addition, unraveling of the knot can be a problem for small children, who are unable to re-tie the knot, and may trip or fall due to the open laces. Elderly people may also have problems bending down to re-tie a shoelace when there is no place nearby to sit down to re-do the knot.

Currently, there are several products on the market that may be used to achieve a similar result, but function differently. They are commonly referred to as "tie-less" shoe laces. One product is a shoelace in the form of a coil (identical to coiled telephone cord that connects the hand held receiver to the dialing device or wall unit), which is inserted in place of a conventional shoelace. The loose ends remain tightly coiled, and thus do not drag on the floor. In addition, the elasticity of the coil ends allows disabled people to slip their feet into the shoes without having to bend over to adjust or tie laces. However, these laces do not provide as tight a fit as conventional laces with knots, and thus are not suitable for running shoes. Another device, called a "micro-lace", slides over the two ends of an open shoelace, and can be pushed down to tighten the laces. However, the protruding lace ends need to be tied so as not to drag on the floor, and thus a conventional knot is usually needed, even though the shoelace remains snug on the foot due to the micro-lace stop constriction device.

In contrast, the present lace lasso invention is applied after the knot is made in the usual fashion, and simply prevents the knot from unraveling. The shoelace knot ends are encircled by a restraining material, typically an elastic cord, to prevent the knot from unraveling. The restrained knot stalk can be attached to the shoe, or left as is, depending on the requirements of the user.

SUMMARY OF THE INVENTION

There are two significant components which comprise this invention. The first component is a restraining material which can easily encircle the four pieces of the shoelace knot, when grouped in a stalk-like configuration. Candidate materials are elastic cord, thin rope, Velcro fabric, or rubber cord. The second component provides an easily adjustable item which can be used to select the tension on the restraining material. The two prime examples are ripstops (also known as cord locks) for cord material, and Velcro fastener for fabric materials. The design is such that the component pieces of the shoelace knot (loops and ends) can easily and quickly be encircled by the restraining material. Both elastic cord and fabric with Velcro attachments are suitable, since they can be stretched or adjusted to allow for easy encircling or insertion of the knot pieces.

Several mechanisms can work with these materials to allow for easy adjustment of the tension in the material surrounding the knot. The simplest and quickest tension adjusting device is a ripstop, a spring-loaded cylinder with an accessible hole through it when the button on top is depressed to allow free passage of cord through an aperture underneath the spring-loaded button. Ripstops are commonly found on duffel bag cords and cords used in parka hoods to secure them snugly around one's head. After releasing the button when the cord is adjusted, the spring provides a mechanism to lock the cord in place by pressure, preventing the cord from relaxing tension on the part surrounding the shoelace knot stalk. Velcro can also be used with fabric strips, which are wound around and object and then secured with a Velcro strip to prevent unraveling and slippage.

Another component of the lace lasso is an optional link between the restraining material encircling the knot stalk and the shoe itself. This linkage can prevent the knot stalk from flopping around by securing it tightly to the shoe top. Candidate materials are the same as those used for encircling the knot. The distance between the point at which the shoe knot is encircled and the location at which it is attached to the shoe can be controlled by the amount of play in the cord or fabric used to grab the knot stalk. A ripstop cylinder can easily be adopted to meet these requirements. Velcro fasteners require more manual dexterity in securing the shoelace knot, since they have to be wrapped more carefully to ensure a snug fit.

DETAILED DESCRIPTION PREFERRED EMBODIMENTS

Figure 1:
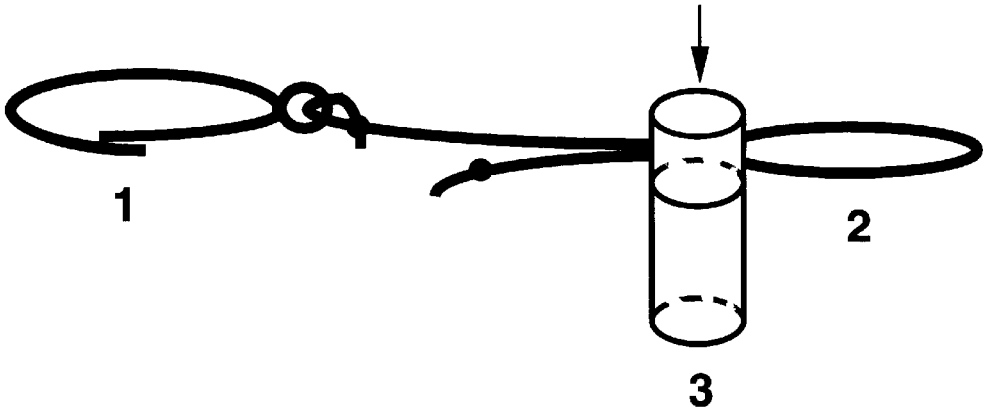
FIG. 1. shows a ripstop cylinder for adjusting the size of the loop of restraining cord that will encircle the knot ends, along with a clip for attaching the device to the shoelace at a spot distant from the knot.
Figure 2:
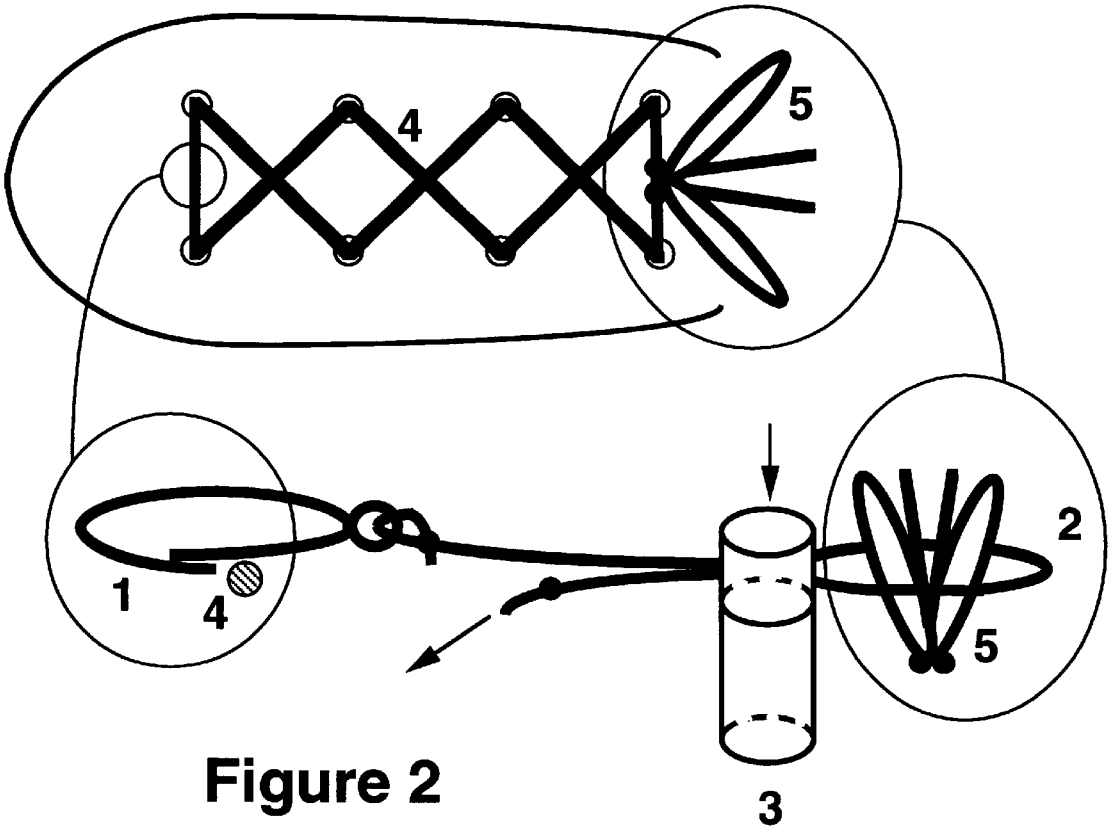
FIG. 2. shows a schematic top view of a running shoe with identification of where the lace lasso components attach to the shoe and the bow tie shoelace knot.

A preferred embodiment of the invention is shown in FIGS. 1 and 2, in which a ripstop is used with elastic cord. The device is attached to the shoe by means of a carabiner-type clip 1 which is slipped over the shoelace 4 near the bottom section of the shoelace eyelets. This prevents loss of the device when the shoelace is untied and the shoe is removed from the foot. A loop 2 is created from elastic cord, and the ripstop 3 is slid back as far as it can go by depressing the button on top and pulling simultaneously on the loop 2. Knots on each end of the elastic cord prevent the ripstop from slipping off of the cord at the distant end. The bow tie knot on the shoelace 5 is slipped through the open loop 2 and the ripstop 3 is slipped in the reverse direction by pulling on the knotted ends of the cord while simultaneously depressing the ripstop button. Pulling on the loose end of the cord while depressing the ripstop button allows slack in the cord to be removed and prevents the knot stalk from flopping around too much.

Figure 3:
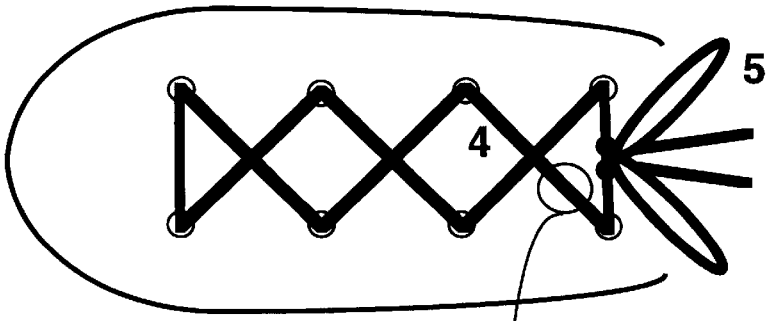
FIG. 3. shows an alternate configuration for the device in which the ripstop loop is secured by threading the shoelace end through the loop before the bow tie knot is made; no other attachment point to the shoe is necessary.

FIG. 3 illustrates another way to attach the ripstop loop to the shoe, in which the shoelace 4 is threaded through the ripstop loop 2 during the initial installation of the shoelace through all the eyelets, before a knot is tied. The ripstop button is pushed and it is slid down against the bow tie knot 5 to secure it tightly to the shoe. To transfer the device to another set of shoes requires the partial unlacing of the shoelace. A simpler means of attachment, not requiring the partial unlacing of the shoelace, can be accomplished by sliding the ripstop loop under the shoelace (at any eyelet level) just prior to tightening the shoelace and tieing the knot. After the shoelace knot is securely fashioned, the bow tie knot is slipped through the ripstop loop, and the ripstop button is push and the ripstop is slid down by pulling on the elastic cord ends. This constricts the ripstop loop tightly around the bow tie knot stalk and pulls the stalk tightly to the eyelet channel. The shoelace prevents the ripstop loop from slipping off the knot stalk, and there is sufficient play that the ripstop loop can be opened when taking off the shoe by pushing the button and pulling on the knot stalk at the same time. However, the ripstop will not be securely fastened to the shoe after the shoelace knot is untied (making its removal fast and simple), although the user will need to remove the ripstop for storage for later use.

Figure 4:
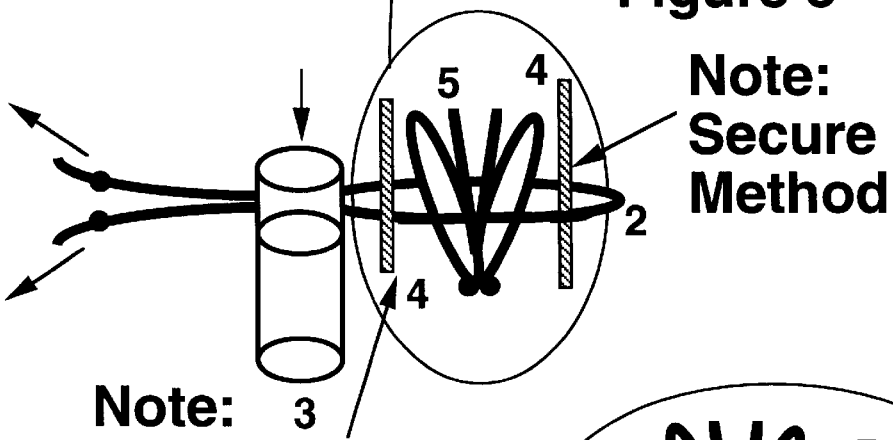
FIG. 4. shows a double-side Velcro fastener which hooks around the shoelace away from the knot and also around the ripstop loop so as to secure the ripstop loop assembly to the shoe. The upper insert shows an alternate configuration in which the Velcro fabric loop is used to secure the bow tie knot ends directly.
Figure 4:
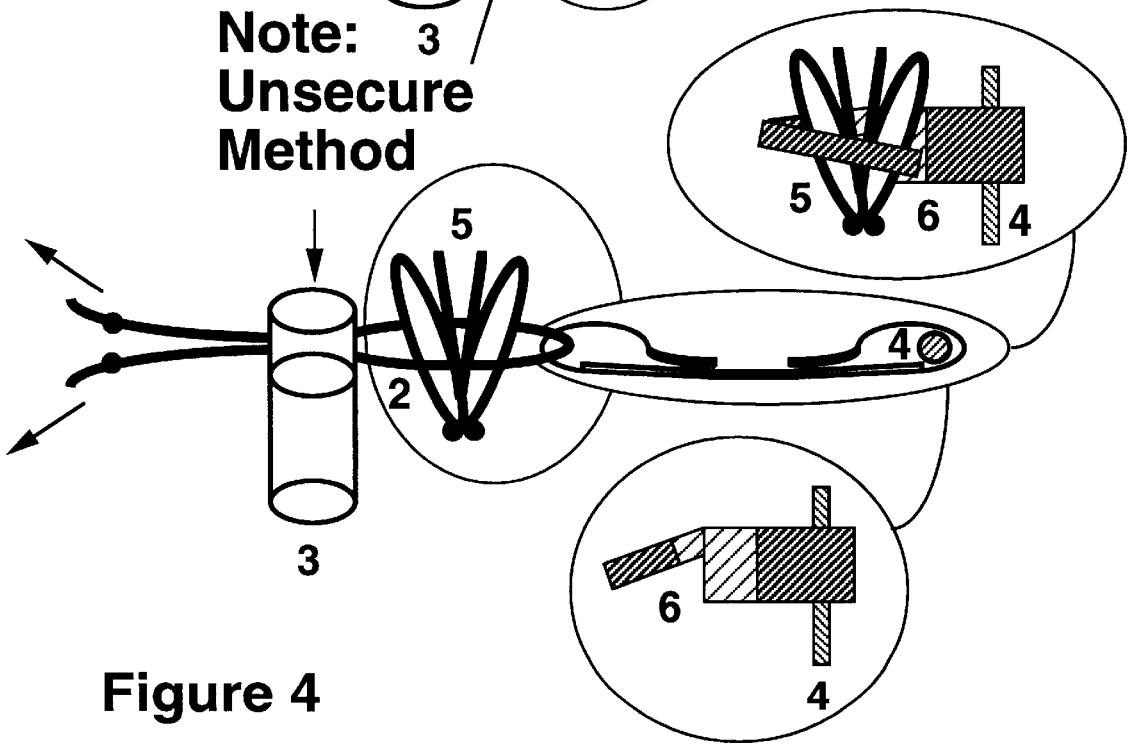

FIG. 4 shows a design in which a Velcro strip 6 can be slipped under a section of the shoelace 4 and secured by a loop with Velcro material. Another Velcro loop on the other end of the strip 6 can be used to hook through the ripstop loop 2 which is used to grab the bow tie knot stalk 5 to secure it. Alternately, as shown in the top insert of the figure, the Velcro strip itself can be used to encircle and secure the knot stalk 5.

Figure 5:
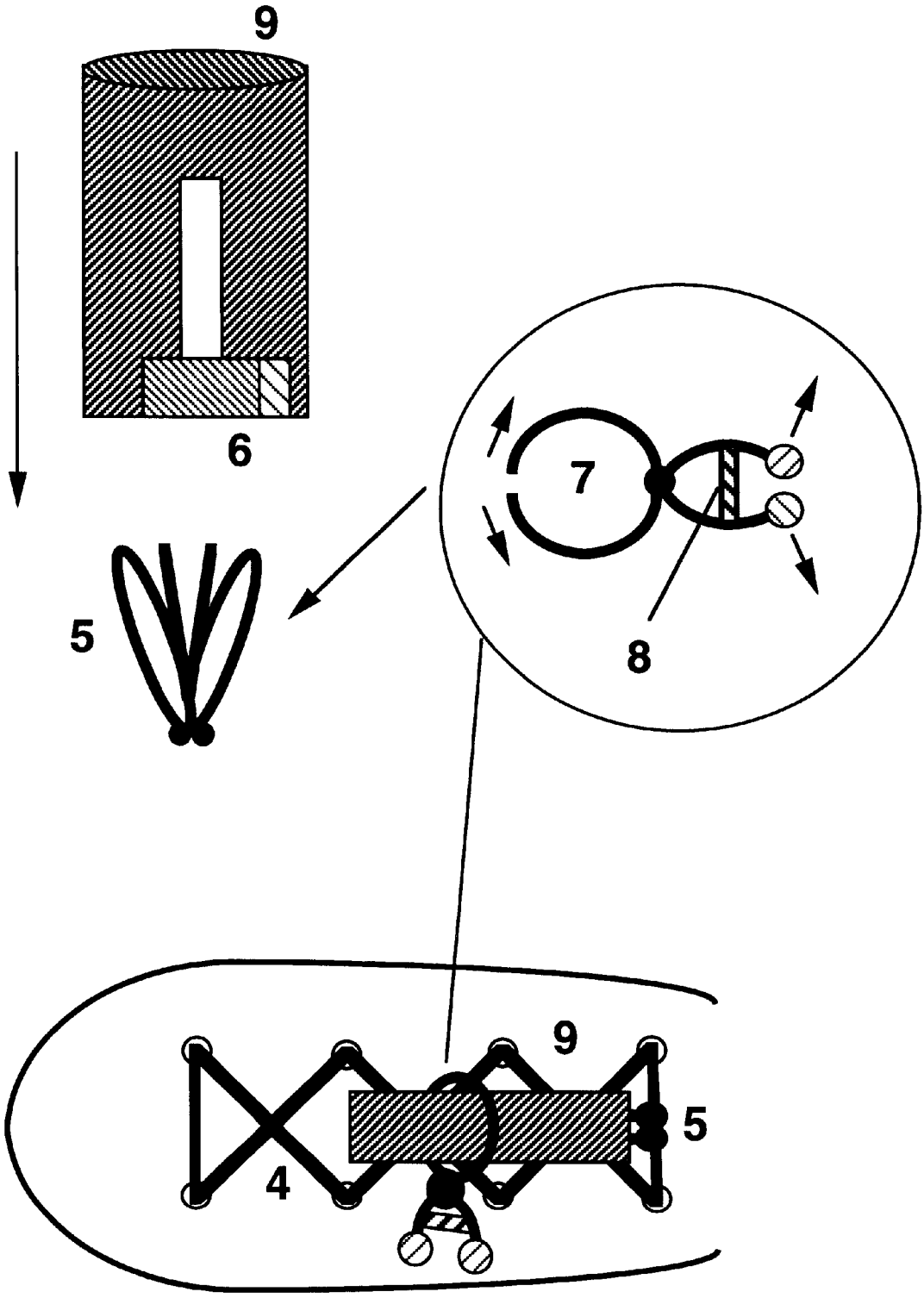
FIG. 5. shows an alternate design in which a cylindrical fabric shroud with a Velcro fastener at the bottom is used to slide over the bow tie knot stalk, and then is secured with a pliers-like device that is spring loaded to maintain a snug grip on the shoelace stalk and protective fabric shroud. The pliers-like device can be attached to the shoe or left free.

FIG. 5 is an alternate design in which a fabric shroud 9 is slipped over the knot stalk 5 and secured by an attached Velcro strip 6. The shrouded stalk can then be secured by a pliers-like device with circular jaws 7 which is kept closed around the knot stalk and shroud by a spring mechanism 8. This design can be implemented without the shroud for quick and easy attachment. The shroud can protect the bow tie knot loops from getting snagged in rough terrain, where there are twigs, branches and weeds which could catch one of the knot loops if they were not covered.

Figure 6:
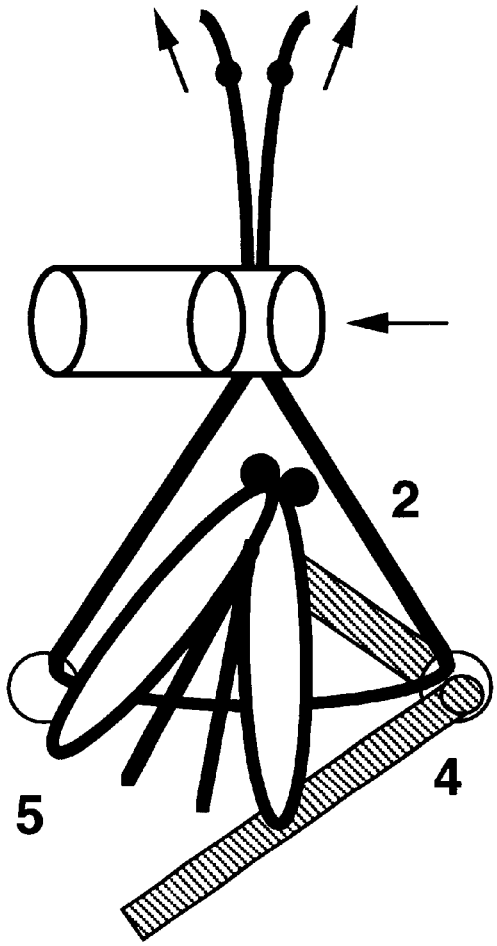
FIG. 6. shows a method of attachment of a ripstop loop to the shoe by threading the ripstop cord through the same shoe eyelets that the shoelace uses. The bow tie knot is then inserted through the loop before the ripstop is slid snugly down on the knot stalk.

FIG. 6 shows another variation in which a ripstop and cord loop can be attached to the shoe by threading the loop through the same eyelets used by the shoelace, prior to knots being made in one end of the ripstop cord. This makes removal more complicated, but produces a lighter and easier design to secure the knot and also open it when the shoe is taken off.

Figure 7:
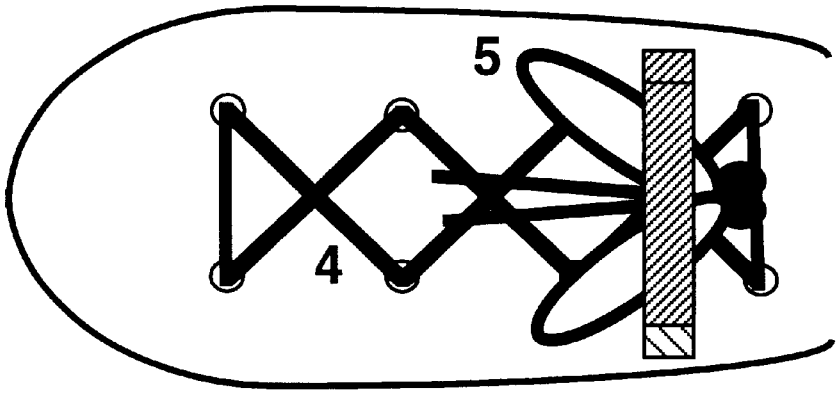
FIG. 7. shows a design in which a Velcro strip is brought over the knot stalk and attached to the other side of the shoe with a Velcro fastener strip which is built into the shoe by the manufacturer.

Finally, FIG. 7 shows a simple design that can be built into the shoe by the manufacturer, in which a Velcro strip is sewn into the shoe, with a Velcro pad placed on the opposite side of the anchor point of the strip to provide an adjustable tension over the bow tie knot, which is folded down and placed under the thin Velcro strip which is then secured on the other side of the eyelets with sufficient tension to keep the knot stalk stationary. This design is more suited to running shoes than other designs, which can be used with any type of shoe construction and environment. An alternate implementation could utilize an additional set of attached eyelets or metal loops, one on each side of each row of regular eyelets, which can be bridged with a removable elastic cord and clips/carabiners on each end to secure the knot stalk. The elastic cord could also be used without attached eyelets, by clipping the ends to existing lacing.

What is claimed is:

1. A mechanical device to prevent shoelaces from becoming untied, comprising;

means to encircle, common shoelace bow tie knot components consisting of two loops and two loose ends using an encircling restraining material, wherein;

said encircling restraining material is selected from a group comprising; rope, cord, elastic cord, elastic rubber cord, or fabric;

means to adjust the snugness of said encircling restraining material encircling any of said knot components, wherein;

said means to adjust the snugness of said encircling restraining material is selected from a group comprising; a ripstop, or spring-loaded mechanical clamping devices;

means to attach portions of said encircling restraining material to the shoe or shoelace, wherein;

said means, to attach portions of said encircling restraining material to the shoe or shoelace is selected from a group consisting of a spring loaded mechanical clamping device or a carabiner clip, and;

means to adjust the separation between said encircling restraining material and the point at which said means to attach said encircling restraining material is attached to the shoe or shoelace.

2. A device according to claim 1 wherein the shoe manufacturer provides a built-in small attachment loop for said means to attach portions of said encircling restraining material to the shoe.

3. A mechanical device to prevent shoelaces from becoming untied, comprising;

means to encircle common shoelace bow tie knot components consisting of two loops and two loose ends using an encircling restraining material, wherein;

said encircling restraining material is selected from a group comprising; rope, cord, elastic cord, elastic rubber cord, or fabric;

means to adjust the snugness of said encircling restraining material encircling any of said knot components, wherein;

said means to adjust the snugness of said encircling restraining material is selected from a group comprising; a ripstop, or spring-loaded mechanical clamping devices, and wherein;

said encircling restraining material and said means to adjust the snugness of said encircling restraining material are not securely attached to said shoe or shoelace, making use or transfer to other shoes easier, but is positioned on said shoe by one of the following methods;

said encircling restraining material is slipped under the shoelace at any location prior to tieing the actual shoelace knot, and said knot is then slipped through a loop created by said encircling restraining material, which is then tightened by said means to adjust the snugness of said encircling restraining material or;

said encircling restraining material is slipped over said shoelace bow tie knot components and then tightened by said means to adjust the snugness of said restraining material, with no other attachments to said shoe or shoelace.

4. A device according to claim 3 wherein said encircling restraining material is selected to be fabric, in the form of a cylindrical shroud, which is slipped over said knot components to protect said knot components from becoming entangled with the surrounding environment.

* * * * *